US005327590A

United States Patent [19]

Last

[11] Patent Number: 5,327,590

[45] Date of Patent: * Jul. 12, 1994

[54] AUTOMATIC SWIMMING POOL COVER WITH A DUAL HYDRAULIC DRIVE SYSTEM

[76] Inventor: Harry J. Last, 1246 Birchwood Dr., Sunnyvale, Calif. 94089

[ * ] Notice: The portion of the term of this patent subsequent to Feb. 9, 2010 has been disclaimed.

[21] Appl. No.: 913,796

[22] Filed: Jul. 16, 1992

Related U.S. Application Data

[63] Continuation-in-part of Ser. No. 741,480, Nov. 28, 1991, Pat. No. 5,184,357, which is a continuation-in-part of Ser. No. 494,564, Mar. 16, 1990, Pat. No. 5,067,184, which is a continuation-in-part of Ser. No. 258,000, Oct. 17, 1988, Pat. No. 4,939,798.

[51] Int. Cl.[5] ..... E04H 4/10

[52] U.S. Cl. ..... 4/502

[58] Field of Search ..... 4/502; 242/75.53, 86.52

[56] References Cited

U.S. PATENT DOCUMENTS 4,939,798 7/1990 Last ..... 4/502

5,184,357 2/1993 Last ..... 4/502

*Primary Examiner*—Charles E. Phillips

[57] ABSTRACT

A hydraulic drive system is described for automatic swimming pool cover systems in which a hydraulic drive provides torque for both resisting cover drum rotation during cover extension across the pool and rotating the cover drum for cover retraction, while a separate second hydraulic drive provides torque for both rotating the cable reels for cover extension and resisting cable reel rotation during cover retraction.

15 Claims, 4 Drawing Sheets

AUTOMATIC SWIMMING POOL COVER WITH A DUAL HYDRAULIC DRIVE SYSTEM

RELATED APPLICATIONS

This application is a continuation-in-part of application Ser. No. 07/741,480 filed Nov. 28, 1991 in the United States of America by the applicant, Harry J. Last, entitled "AUTOMATIC SWIMMING POOL COVER WITH A DUAL HYDRAULIC DRIVE SYSTEM" now U.S. Pat. No. 5,184,357 which was initially filed in the United States under the Patent Co-operation Treaty (PCT) on Jul. 24, 1990. Application Ser. No. 07/741,480 in turn is a continuation-in-part of Ser. No. 07/494,564 filed Mar. 16, 1990, now U.S. Pat. No. 5,067,184 issued Nov. 26, 1991 to the applicant, Harry J. Last, entitled "A COVER DRUM HAVING TAPERED ENDS FOR AN AUTOMATIC SWIMMING POOL COVER". U.S. Pat. No. 5,067,184 is a continuation-in-part of Ser. No. 07/258,000 filed Oct. 17, 1988, now U.S. Pat. No. 4,939,798 issued Jul. 10, 1990 to applicant, Harry J. Last, entitled: "LEADING EDGE AND TRACK SLIDER SYSTEM FOR AN AUTOMATIC SWIMMING POOL COVER".

BACKGROUND OF THE INVENTION

1. Field of the Invention

The invention relates to automatic swimming pool cover systems, and in particular, to hydraulic drive systems for rotating the cable reels and cover drum for extending and retracting pool covers back an forth across a swimming pool.

2. Description of the Prior Art

Automatic swimming pool cover systems typically include a flexible vinyl fabric sized so that most of it floats on the surface of the pool water. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or the the underside of an overhanging coping along the sides of the swimming pool. The cables extending from the beaded tape sections of the cover are trained around pulleys at the distal ends of the tracks and return in a parallel "C" channel to the drive mechanism where they wind around cable take-up reels.

To uncover the pool, the drive mechanism rotates a cover drum mounted at one end of the pool winding the pool cover around its periphery and unwinding the cables from around the take-up reels. To cover the pool the drive mechanism rotatably drives the cable take-up reels winding up the cables to pull the cover across the pool unwinding the cover from around the cover drum.

The rate at which the pool cover unwinds from and winds onto the cover drum varies depending on the diameter of the roll of the cover still wound around the drum, i.e., the rate is greatest when most of the cover is wound around the drum (largest diameter) and least when the cover is practically unwound from the drum (least diameter). The same phenomenon occurs as the cables wind onto and unwind from the cable reels. It should be appreciated that the cables wind onto the cable reels at the highest rate when the cover unwinds from the cover drum at its lowest rate and visa-versa In systems where the cable take-up reels and the cover drum rotate together on the same axle, but oppositely wind/unwind the cables and cover respectively, a spring is utilized as a tensioning take-up mechanism to compensate for the different and varying rates at which the cables and pool cover wind and unwind from the respective reels and drum during the opening and closing cycles. The spring mechanism lengthens and shortens the cable path as the cover is drawn back and forth across the pool taking up and yielding slack in the respective cables as necessary to compensate for the differences in the winding and unwinding rates of the reels and drum. [See U.S. Pat. Nos. 3,747,132 & 3,982,286, Foster].

In spring tensioning take-up systems of the type described by Foster, and later floating spring tensioning take-up systems of the type pioneered by Last, the applicant herein, the tensioning of the cables by the spring(s) assures that the cover, and especially its beaded edges curling around the ends of the drum, wind tightly and uniformly without substantial bias around the cover drum as the cover is retracted from across the pool. However, there is an upper limit beyond which the tensioning/compensating spring of such single axle systems can not compensate for the differential in winding rates of the cover and cables. [See U.S. Pat. No. 3,982,286, Foster, Col. 5, 1.36–Col. 6, 1.4. See also related U.S. Pat. No. 4,939,798].

In other systems, a clutching mechanism is typically utilized to decouple the rotation of the cable reels from that of the cover drum as it is rotatably driven to wind the cover onto the drum uncovering the pool, and to decouple the rotation of the cover drum from that of the cable reels as they are rotatably driven to draw the cover across the pool. Typically, in such systems, the cable reels are allowed to free wheel when the cover drum is rotatably driven and conversely, the cover drum to free wheel when the cable reels are rotatably driven. [See U.S. Pat. Nos. 3,019,450 & 3,050,743, Lamb].

In clutch de-coupled systems of the type pioneered by Lamb, in order to prevent biasing of the cover as it winds around the cover drum during retraction and to assure that the cover winds compactly and uniformly around the drum, adjustable braking mechanisms are utilized to slow or resist rotation of the respective free wheeling take-up reels to provide the necessary tension in the cables for assuring that cover edges curl around the ends of the cover drum. Such braking mechanisms typically are adjustable for each take-up reel. Also, a braking system necessary to prevent the cable reels from freewheeling when the cover is retracting otherwise because the reel diameter decreases as the cables unwind, the reels over rotate entangling the cables, a phenomenon referred to backlash in fishing reels, and bird-nesting pool cover industry. Moreover, the resistance provided such braking systems is typically not sufficient to prevent unwinding of the cable reels when a heavy object falls on an extended cover, a circumstance that can cause the cover to partial retract (open) presenting a child drowning hazard.

In early automatic pool cover systems the rigid boom spanning the width of the pool holding the front edge of the cover above the water was typically supported by a pair of wheeled dollies rolling on the side edges of the pool. The cables moving within the "C" channels of the track along either side of the pool were either directly secured in some fashion to the rigid boom, [Foster, supra], or were indirectly secured to the ends of the boom via fabric interfaces referred to as gores. [See U.S. Pat. No. 4,001,900, Lamb].

Slider mechanisms have supplanted the use of wheeled dollies for supporting the rigid boom carrying the front edge of the cover. Typically, such slider mechanisms are coupled to the respective ends of the boom and have an edge adapted for capture and sliding within the same or different "C" channels of the extruded track in which the beaded side edge of the cover is captured and slides. [See U.S. Pat. No. 4,686,717, MacDonald et al. & U.K. Pat. No. 2,072,006, Lee].

As pointed out and extensively discussed in Applicant's related U.S. Pat. No. 4,939,798, in systems where slider mechanisms support the rigid boom, it is very important to maintain the boom oriented squarely between the track channels, otherwise the sliders carrying the boom will jam in the track channels stopping extension or retraction of the cover.

Also, in related U.S. Pat. No. 4,939,798, the Applicant describes and claims slider mechanisms which couple steel cables to the lines incorporated into the respective beaded edges of the cover. The steel cables extend between the sliders and the take-up reels. [See FIGS. 12 & 12*a*; col. 15, 1.37–col. 16, 1.7and claims 44; and claims 47–49].

SUMMARY OF THE INVENTION

The invented hydraulic drive for swimming pool covers systems includes a first reversible hydraulic motor mechanically coupled for rotating cable reels around which cables, extending from sliders secured to beaded side edges of a pool cover, wind and unwind, a second reversible hydraulic motor mechanically coupled for rotating a cover drum around which the pool cover winds and unwinds, a source of hydraulic pressure, and a means hydraulically coupling the respective motors to the source of hydraulic pressure for: (i) providing a driving torque, via the first motor, for rotating the cable reels winding up the cables while simultaneously providing a resistive torque, via the second motor, resisting rotation of the cover drum as the cover unwinds and is drawn across covering the pool; and (ii) providing a driving torque, via the second motor to wind the cover around the cover drum retracting it from across uncovering the pool, while simultaneously providing a resisting torque, via the first motor, resisting rotation of the cable reels to tension the cables and cover as the cover retracts and winds around the cover drum.

In particular, the respective reversible hydraulic motors each function as both a motor and a pump and are mechanically coupled by the interconnecting cables and cover winding and unwinding from around the respective cable reels and cover drum such that when one motor is hydraulically driven to provide torque, the other motor hydraulically responds as a pump. The hydraulic exhaust from the driving motor provides hydraulic input for the pumping motor.

Control is accomplished by utilizing a three position hydraulic valve for reversing flow of hydraulic liquid from the source of hydraulic pressure through the respective motors/pumps. More directly, a reversible electrical motor is utilized to drive a third hydraulic motor/pump at a location remote from the swimming pool.

An aspect of the invented hydraulic drive system relates to the use of relative inelastic cables coupling between sliders secured at the leading edge of the pool cover and the cable reels. In particular, by appropriately selecting the cable reel diameters relative to the respective radii of the cover drum when the cover is fully extended and retracted, and utilizing small diameter steel cables between the sliders carrying the rigid leading edge and the cable reels, the friction resistance of the sliders and beaded side edges of the cover sliding within the respective 'C'-channels of the track and the elasticity of the pool cover as it winds and unwinds from around the cover drum will inherently equalize tension in the respective cable lines and compensate for small differences in the rates at which the respective cables wind and unwind from around the cable reels.

A particular novel and advantageous feature of the invented hydraulic drive system is that limit switches for interrupting cover extension/retraction can be eliminated by appropriate adjustment of pressure relief valves which limit the driving torque available for rotating the cable reels and the cover drum during cover extension and retraction, respectively, such that an increase in torque load above a threshold value stops extension/retraction.

Another advantage of the invented drive system is that a tension load on the cover and cables can be established and then maintained relatively constant as the cover extends and retracts, as well as when the cover is at rest, in the fully extended and retracted positions, in contrast, to spring tensioned, single axle systems in which tension increases and decreases as the cover extends and retracts back and forth across the pool, and in contrast to clutch de-coupled systems in which can not maintain any tension on the fully extended and/or retracted cover.

A particular object of the invented drive system is control over the tension in the cables and cover during cover extension and retraction achieved by establishing a back pressure in the output line from the motor functioning as a pump using a flow restrictor.

Still another advantage of the invented drive system is that the differential in winding/unwinding rates of the cover and cables do not impose an upper limit on the length of pool that can be covered and uncovered by the automatic cover system.

Other advantageous features of the invented drive system relate to elimination of electrical power hazards in the the pool environment in that electrically driven hydraulic power components can be located remotely.

Another aspect of the invented drive system is that the cover drum disposed at one end of the pool can be located in a trench flooded with pool water to provide buoyant support to the cover drum and cover drum roll for counterbalancing bending moments on the cover drum due to the weight of the cover wound around it.

Still other features, aspects, advantages and objects presented and accomplished by the invented hydraulic drive system for automatic swimming pool covers will become apparent and/or be more fully understood with reference to the following description and detailed drawings of preferred and exemplary embodiments.

DESCRIPTION OF PREFERRED AND EXEMPLARY EMBODIMENTS

Figure 1:
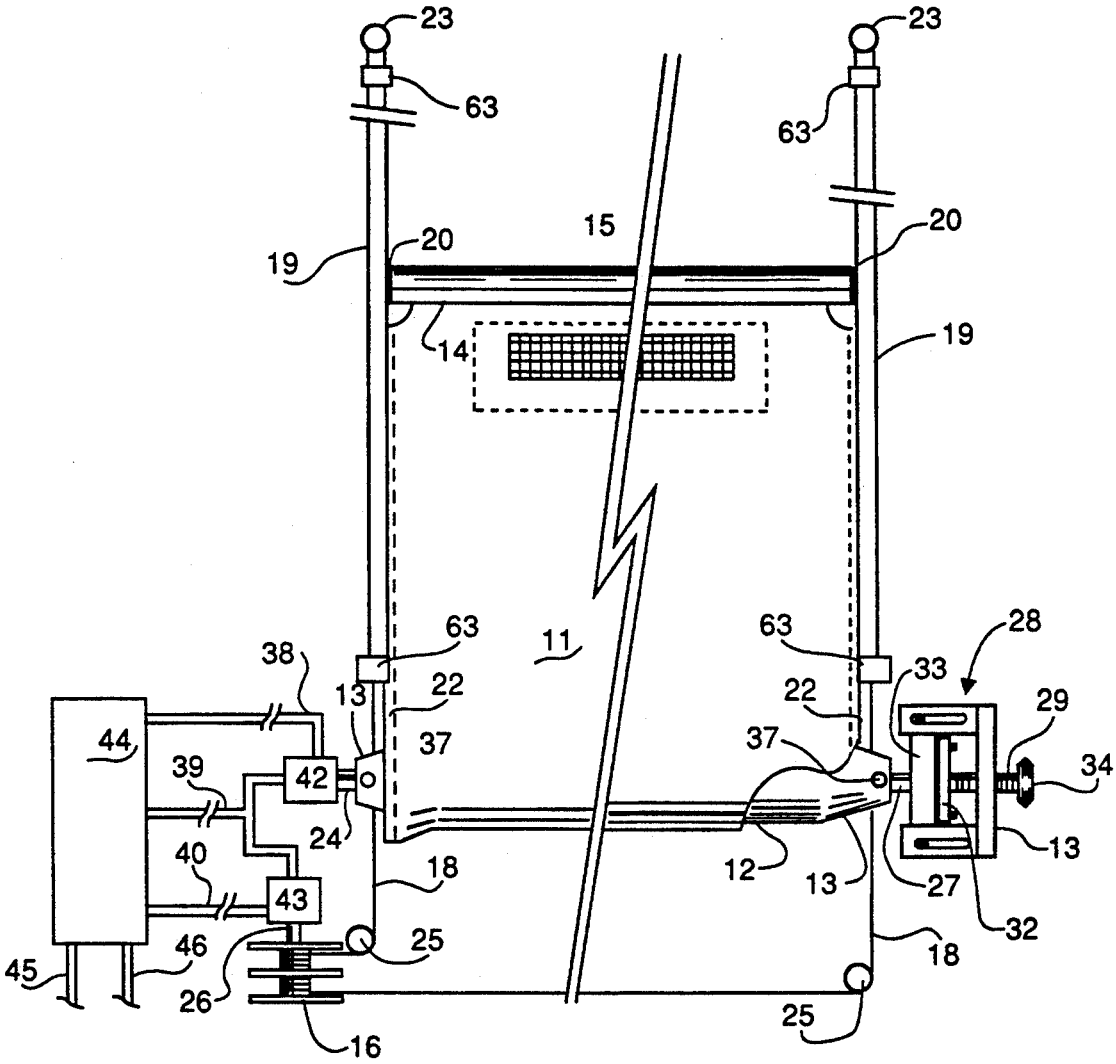
FIG. 1 is a top plan view of an automatic swimming pool cover system incorporating and illustrating the essential components of the invented dual hydraulic motor drive system.

Referring to FIG. 1, a top plan view of an automatic pool cover system is shown which includes a leading edge and slider system of the type described in Applicant's U.S. Pat. No. 4,939,798, entitled "LEADING EDGE AND TRACK SLIDER SYSTEM FOR AN AUTOMATIC SWIMMING POOL COVER" and with conically tapered hubs at either end of the cover drum as described Applicant's U.S. Pat. No. 5,067,184 entitled, "A COVER DRUM HAVING TAPERED ENDS FOR AN AUTOMATIC SWIMMING POOL COVER."

As shown in FIG. 1, a flexible vinyl fabric pool cover 11, is attached for winding around a cylindrical cover drum 12 with conically tapering end sections or hubs 13 supported for rotation at the end of a swimming pool (not shown). The front edge 14 of the cover 11 is supported by a rigid leading edge 15 spanning the width of the pool above the water between conventional parallel "C" channel swimming pool tracks 19 secured along the sides of the swimming pool. Sliders 20 coupled at each end of the rigid leading edge 15 are fastened to small diameter steel cables 18. The sliders 20 are captured and slide within the "C" channels of the respective tracks 19. [See U.S. Pat. No. 4,939,798.

Figure 4:
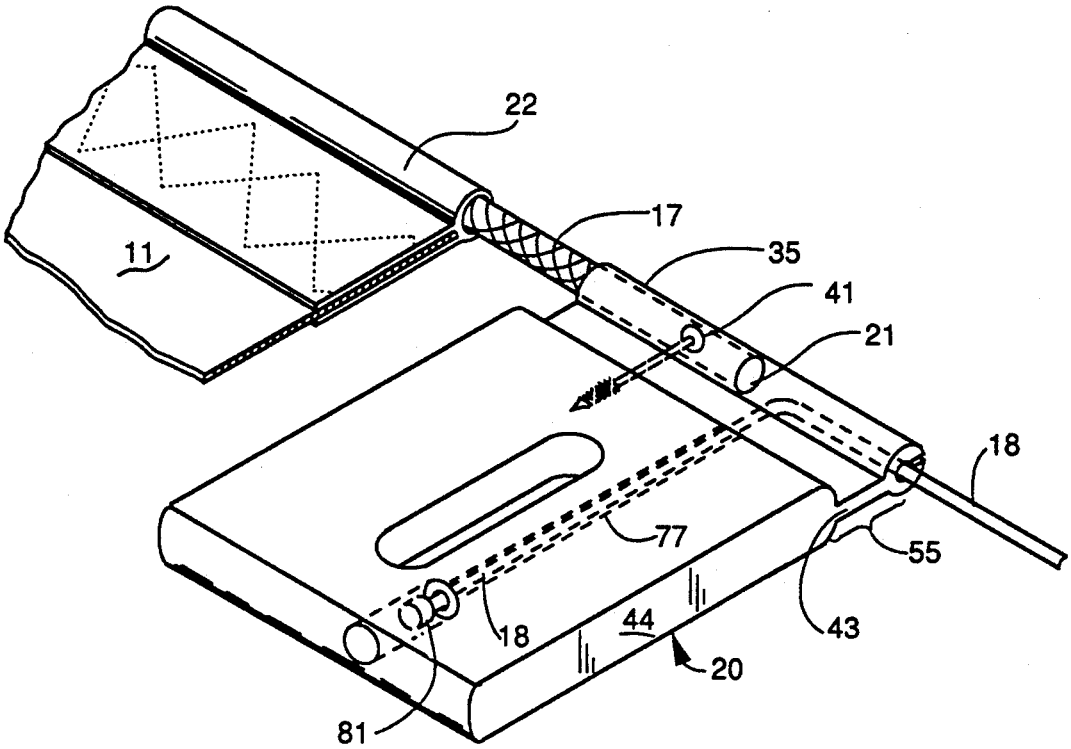
FIG. 4 is an enlarged view of the slider described in related U.S. Pat. No. 4,939,798 coupling steel cables winding around the cable reels, the rigid leading edge and the lines extending from the beaded side edges of the pool cover.

In particular, referring to FIG. 4, lines 17, typically Dacron rope, are incorporated into and form a beaded tape 22 sewn to the side edges of the cover 11. The ends 21 of the lines 17 extend from the front corners of the cover 11, and are inserted partway through a hollow cylindrical sliding edge 35 of the slider 20. The line ends 21 are anchored within the hollow cylindrical sliding edge 35 utilizing smooth shank screws 41. A small diameter steel cable 18 with a stop 81 fastened at its end is introduced via a passageway 77 through the slider 20, oriented perpendicularly with respect to the hollow cylindrical sliding edge 35. The cable 18 then threads out the other end of the hollow cylindrical sliding edge 35 to ultimately connect and wind onto a take-up reel 16. (FIG. 1)

In particular, referring back to FIG. 1, each steel cable 18 extends from the slider 20, is trained around a pulley 23 at the distal ends of the tracks 19, and return via return internal "C" channels within the respective tracks 19 to ultimately connect with and wind onto a pair of cable take-up reels 16. Return pulleys 25 provide the necessary changes of direction between the return channels of the tracks 19 and the cable reels 16. The beaded tapes 22 sewn to the side edges of the cover 11 are also captured by and slide within the conventional "C" channels of the respective tracks 19.

The cover drum 12 is supported for rotation between the respective tracks 19, within a trench located at one end of the pool (FIG. 5) by a translating bearing block 28 and a bearing block (not shown) receiving and supporting axles 24 and 27 coaxially extending from the conical hubs 13 at either end of the cover drum 12. Additional bearing blocks can be journaled around to the respective supporting axles 24 & 27 to provide additional capacity (and/or rigidity) for mechanical supporting the cover drum 12. However, care should be exercised in locating such additional bearing blocks to insure a desired range of axial translation of the cover drum drive train.

The cover drum drive train including the conical hubs 13 and axles 24 & 27 can be translated along the longitudinal rotational axis of the cover drum 12 utilizing the translation bearing block 28. In particular, the bearing block 28 includes a helically threaded shaft 29 threaded through the rear wall of a rigid hexahedral frame 31. The end of the shaft 29 is mechanically coupled by a conventional non-rotating collar 32 to a translating frame 33 supporting a bearing receiving the axle 27. An adjustment knob or crank 34 is is mechanically fastened to the opposite end of the shaft 29 extending out of the hexahedral frame 31.

To adjust the position of the cover drum drive train between the parallel tracks 19, the bolts 36 securing the bearing frame 33 within the hexahedral frame 31 of the translating bearing block 28 are loosened sufficiently to allow translation of the cover drum drive train. Shaft 29 is rotated with a crank 34 by hand to translate the cover drum drive train to a new position. The bolts 36 are then re-tightened and the cover and cables re-tensioned by re-engaging the ratchet mechanism and turning either the cover drum 12 or cable reels 16. Diametric holes 37 located near the apex of the conical hubs 13 adapted to receive a longitudinal bar or crank (not shown) for manually turning the cover drum 12 can be utilized for re-tensioning the system.

As shown in FIG. 1, the drive of a first reversible hydraulic motor 42 is mechanically keyed to for rotating the end of axle 24 extending from the cover drum 12. The drive of a second reversible hydraulic motor 43 is mechanically keyed to for rotating axle 26 and the cable reels 16. Hydraulic lines 38, 39 & 40 connect between the respective motors 42 & 43 and a hydraulic circuit manifold 44. The common hydraulic line 39 also connects between the motors 42 & 43. High pressure hydraulic input and output lines 45 & 46 connect between a reversible hydraulic pump 47 and the hydraulic circuit manifold 44 to complete the hydraulic circuit for the reversible motors 42 & 43. (See FIG. 2) Alternatively, with reference to FIG. 2*a*, a three position solenoid valve 49 for directing flow from a source of pressurized hydraulic liquid 84 can be substituted for the reversible pump 47 in the hydraulic circuit. Source/exhaust hydraulic lines 48 connect the hydraulic circuit for the reversible drive motors 42 & 43 to a hydraulic liquid reservoir tank 50. Check valves 51 in source/exhaust lines 48 prevent the hydraulic liquid from draining from the hydraulic circuit for the reversible drive motors 42 & 43. The reversible hydraulic pump 47 is driven by a reversible electrical motor 60.

Figure 2:
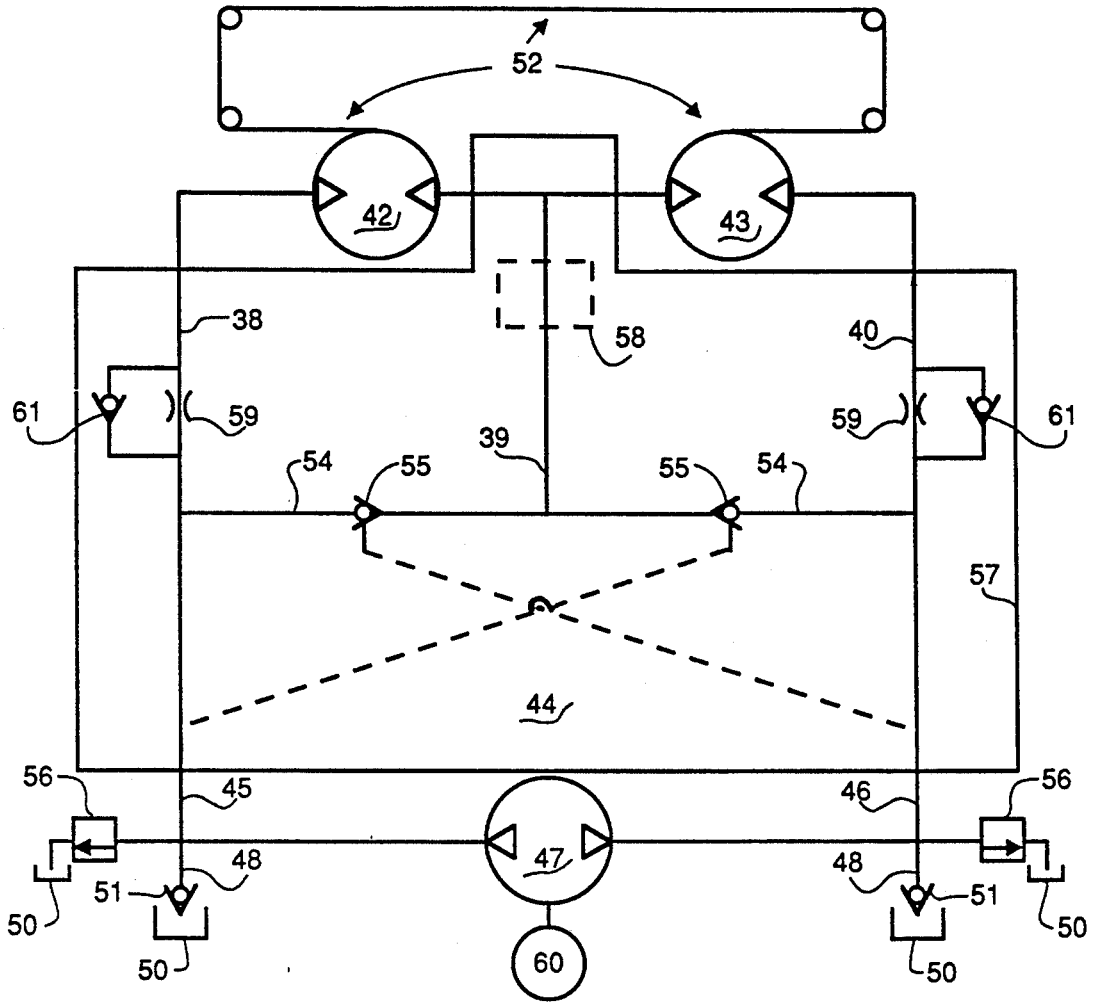
FIGS. 2 and 2*a* are a schematic drawing showing the components of the hydraulic circuit for the invented dual hydraulic motor drive system.

In more detail, referring to FIG. 2, the basic hydraulic circuit for the reversible drive motors 42 & 43 includes: (i) the reversible drive motors 42 & 43; (ii) components 52 of the pool cover system mechanically coupling the respective drives of the motors 42 & 43, i.e., the pool cover 11, the cover drum 12, the lines 17 and cables 18, and the cable reels 16; (iii) the reversible pump motor 47; the input/output line 38 for the cover drum reversible drive motor 42; (iv) the input/output line 40 for the cable reel reversible drive motor 43; (v) the common line 39 hydraulically coupling the reversible motors 42 & 43; (vi) anti-cavitation lines 53 & 54 connecting the common line 39 to the respective input-/output lines 38 & 40; (vii) a pair of pilot pressure check/lock valves 55 in the respective lines 53 & 54 for isolating the the common line 39 from the respective input/output lines 38 & 40; (viii) a pair of adjustable pressure relief valves 56 in the respective input/output lines 38 & 40; (ix) cheek valves 51; and (x) the hydraulic liquid reservoir tank 50. (The components within the hydraulic circuit manifold 44 are indicated by the enclosing line 57).

In operation high pressure hydraulic liquid is supplied to one or the other of the reversible hydraulic motors 42 & 43 to provide torque at its drive shaft for rotating either the cover drum 12 or the cable reels 16. The components 52 of the pool cover system mechanically couple that torque to and mechanically rotate the drive shaft of the other reversible motor causing it to function as a pump. The reversible motor receiving the high pressure hydraulic liquid and providing the torque rotating either the cover drum or the cable reels is referred to as the driving motor. The reversible motor being mechanically rotated the by the components 52 of the pool cover system is referred to as the driven or pumping motor.

The common line 39 inherently functions as a liquid source (schematically indicated at 58 in FIG. 2) receiving the hydraulic exhaust from the respective motors 42 & 43 when each is driving as a motor. The common line 39 also functions as a hydraulic liquid supply to the respective motors 42 & 43 when each is driven as a pump. The anti-cavitation lines 53 & 54 with the pilot pressure check/lock valves 55 supply hydraulic liquid to the common accumulator line 39 from the output of the driven or pumping motor via one other or the other of the input/output line 38 & 40 when the hydraulic exhaust of the driving motor is not sufficient to supply the intake of the pumping motor. The anti-cavitation lines 53 & 54 with the pilot pressure check/lock valves 55 also hydraulically function to exhaust excess hydraulic liquid fom the common line 39 to input/output line 40 or 38 when the hydraulic exhaust of the driving motor 42 or 43 exceeds the demand of the pumping motor 43 or 42, respectively.

To explain, as pointed out supra, the cable reels 16 keyed to the drive of the reversible motor 43 rotate at the highest rate when the cover 11 winding around the drum 12 is approaches its maximum radius and the cables winding around the reels approach their minimum radius, i.e. when the cover is nearly retracted from across the pool. And, the torque resistance to the driving motor 42 rotating the cover drum 12 also increases with the winding radius of the cover drum, tending to slightly slow its rate of rotation, depending on the capacity of the pump 47 supplying the high pressure liquid. Conversely, the cover drum 12 keyed to the drive of motor 42 rotates at its highest rate when the cover 11 unwinding from around it approaches its minimum radius and the cable reels 16 approach their maximum radius. And, similarly, torque resistance to the driving motor 43 rotating the cable reels 16 also increases as the cover extends, tending to slow its rate of rotation.

From the above analysis, it should be appreciated that the hydraulic exhaust from the driving motor 42 or 43 stays relatively constant while the demand for hydraulic liquid by the pumping motor 42 or 43 approaches a maximum, and conversely, that the hydraulic liquid exhaust from the driving motor 42 or 43 does not change significantly as demand for hydraulic liquid by the pumping motor 42 or 43 minimizes. Such conditions exist as the leading edge 15 of the cover 11 approaches the respective end points of travel both when the cover 11 is being retracted or drawn from across the pool by winding the cover 11 around the cover drum (when the cover drum motor 42 is driving and the cable real motor 43 is pumping) and when the cover 11 is being extended across by winding the cables 18 around the cable reels 16 (when the cable reel motor 43 is driving and the cable drum motor 42 is pumping).

If the hydraulic liquid exhausting from the driving motor exceeds the demand for liquid of the pumping motor, the pumping motor may be driven or rotated at a faster rate by the hydraulic liquid causing it to unwinding cover 11 or cables 18 at a faster rate than they are being drawn by ther driving motor, with a consequent loss of resistance tension in the components 52 of the pool cover system mechanically coupling the respective drives of the motor 42 & 43. On the other hand, when liquid supply from the driving motor is not sufficient, the pumping motor cavitates which causes a sudden decrease in torque resistance at the drive shaft of the pumping motor and also a consequent loss of resistance tension in the components 52 of the pool cover system mechanically coupling the respective drives of the motor 42 & 43.

The pilot pressure check/lock valves 55 functioning as check valves, prevent over supply or hydraulic driving of the pumping motor by allowing flow of the excess hydraulic from the common line 39 to the respective low pressure input/output line 38 or 40. The pilot pressure check/lock valves 55 functioning as locking valves, prevent cavitation of the pumping motor, by taking a pilot pressure from the input/out line 38 or 40 supplying liquid to the driving motor 42 or 43 for opening the pilot valve 55 to allow flow through an anti-cavitation line 53 from the output of the pumping motor to the common line 39.

In other words, when pressure in the common line 39 exceeds that in the particular output line 38 or 40 from a pumping motor 42 or 43, hydraulic liquid flows from the common line 39 to the output line, i.e., the the pilot check/lock valve 55 functions as a check valve. But when pressure in the common line 39 is less than that in the particular output line 38 or 40 from a pumping motor 42 or 43, the pilot check/lock valve 55 opens and hydraulic liquid flows from the output line to the common line 39, i.e.,the hydraulic output of the pumping motor is coupled to its input allowing the liquid to recirculate through the pumping motor thus precluding cavitation.

Figure 2A:
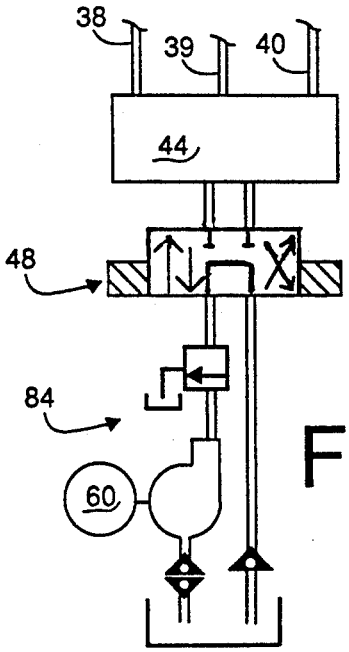

The respective check/lock vales 55 also functionally lock the cover 11 in position when when the reversible pump 47 is not pumping or when the reversible three way valve 49 isolates the manifold from the pressurizing source. To explain, in the absence of differential pressure for forcing circulation of the hydraulic liquid around the respective circuits, liquid pressure will inherently equalizes in the respective input/output lines 38 & 40. This means that there is no differential pressure for opening the pilot check/lock valves, causing both function as a check valves to prevent liquid circulation from the lines 38 & 40 to the common line 39. And, as schematically indicated in FIGS. 2 & 2*a*, the reversible pump 47 precludes liquid circulation between the the input/output lines 38 & 40 when stopped, as does the three way valve 49 when it isolates the manifold 44 from the pressurizing source. In this situation, the respective input/output lines 38 & 40 are liquid full and isolated, thus precluding unwinding (pumping) rotation of either reversible motor 42 or 43. The described locking property of the hydraulic circuit for the reversible drives 42 & 43 provides a particularly advantageous, and inherent safety feature to automatic pool cover systems.

To explain, when a heavy objects, human beings or other animals fall, or step onto an extended cover covering a pool, the resulting tension in both the cables and cover will cause both to unwind, allowing the object, person or animal will sink into the pool enfolded by the cover to the extent permitted by slack in the pool cover between the tracks 19. And, if the leading edge of an extended cover is not secured or anchored, the cover can move partially retracting toward the object, person or animal on the cover surface leaving the end of the pool uncovered. Also if (rain or sprinkler) water is on the surface of the extended cover it will flow into the depression created caused by the object, person or animal presenting an additional drowning hazard. Despite these hazards, some manufacturers of clutch de-coupled systems of the type pioneered by Lamb, often suggest utilizing the above phenomenon for removal of water on the cover surface by placing a relatively heavy sump pump on the cover surface to causing surface water to pool in the resulting depression.

In single axle systems, of the type developed and manufactured for the applicant herein, simultaneous unwinding of the cover and cable reels can not occur as they oppositely wind and unwind so that longitudinal tension on the cover is always maintained, and a fully extended cover can not partially retract. In the invented system, locking the respective reversible drives 42 & 43 hydraulically to preclude simultaneous unwinding rotation of the cover reels and cover drum, similar to single axle systems mentioned, maintains longitudinal tension on the cover and cables when the system is not operating and precludes the cover, when fully extended covering a pool, from partially retacting. And, as with single axle systems, an object placed the cover surface is not only supported transversely by the tracks capturing the beaded side edges of the cover, but also longitudinally, thus preventing to greater degree, excessive sinking of the object into the pool.

In designing the particular hydraulic circuit, and determining the necessary pilot pressures for opening the respective check/lock valves 55 to allow flow between the output and input of the pumping motors 42 & 43, it should also be kept in mind that the pressure in the input/output supply 38 or 40 is at a maximum when the torque load on the driving motor 42 or 43, respectively is at a maximum. Suitable pilot check/lock valves for the described application are, and the equivalents of, the Kepsel TM Cartridge Lock Valve Inserts manufactured and distributed by Kepner Products Co. located at 995 N. Ellsworth Ave. Villa Park, Ill.

Also, to mitigate cavitation problems, it is desirable to locate the hydraulic circuit manifold hydraulically proximate (physically close to) the reversible motors 42 & 43, whereas the reversible pump 47, or three-way solenoid value and source of hydraulic pressure and the hydraulic liquid reservoir tank 50 can be hydraulically remote (physically distant) from the reversible motors 42 & 43. The adjustable pressure relief valves 56 may also be located at the hydraulically remote location.

To further optimize operation of described hydraulic circuit for controlling the reversible motors 42 & 43 extending and retracting the pool cover back and forth across the pool, a flow restrictor 59, with a check valve bypass 61 can be incorporated into each of the input-/output lines 38 & 39 between the respective motors 42 & 43 and the respective connections of the anti-cavitation lines 53 & 54. (See FIG. 2). Accordingly, as schematically indicated in the FIG. 2, when hydraulic liquid is supplied to the reversible motor 42 or 43, it flows via the check value bypass 61 to the motor. However, when the particular motor 42 or 43 is driven as a pump, the output flow is restricted by the flow restrictor 59 to create a desired level of back pressure for tensioning (or braking) the components 52 of the pool cover system as the cover moves across the pool.

Also, to assure that the pumping motor does not cavitate when the system is initially energized to move the pool cover from a fully retracted or extended position, it may be necessary to increase the volume of the common line 39. In particular, it is desirable and sometimes necessary, to assure an adequate supply of hydraulic liquid to meet the demand of the pumping motor which is initially driven at a maximum rate while the driving motor is initially drives (and exhausts liquid) at a minimum rate, until respective rates compensate. Such increase in volume of the common line 39 may be accomplished by increasing the physical size of the hydraulic circuit manifold 44 and by appropriately dimensioning and locating the respective conduits and components making up the circuit within the manifold 44. In such cases the common line 39 is the functional equivilent of an hydraulic accumulator 58 indicated in phantom in FIG. 2.

As previously mentioned, the cover 11 winding and unwinding from around the cover drum 12 and the cables 18 winding and unwinding from around the cable reels 16 provide the mechanical connection between the respective drives of the motors 42 & 43. When motor 42 is driven by the hydraulic liquid rotating the cover drum, motor 43 coupled to the cable reels 16 is rotatably driven as a pump. Similarly, when motor 43 is driven by the hydraulic liquid for rotating the cable reels 16, motor 42 coupled to the cover drum 12 is rotatably driven as a pump.

The torque provided to the driving motor must be sufficient to overcome both the inherent friction of the mechanical components of the pool cover system as well as the tension load imposed on the system by the pumping motor. It should be appreciated that the torque resistance which must be overcome by the driving motor increases with the "winding radius" of cover drum 12 or cable reels 16, and that tension load imposed on the system by the pumping motor also increases as the the "unwinding radius" of the cover 11 around the cover drum 1 or cables 21 around cables reels 16 decreases. The terms "winding radius" and "unwinding radius" refer respectively to the increases and decreases in radius due to layers of cover 11 being wound and unwound from around the drum 12, in the case of the cover drum, and to the layers of cable coils being wound and unwound from around the reels 16, in the case of the cover reels.

Sources of friction inherent in a pool cover system include both constant sources, and variable sources. The constant sources of friction are those which do not vary as the cover extends and/or retracts, e.g. the friction of pulley system directing the cables 18 and the bearings supporting turning axles, the cables 18 moving in the return channels of the tracks 19 and the friction of the sliders 20 supporting the leading edge 15 sliding within the "C" channels of the tracks 19. Variable friction sources are those that vary with the degree of extension/retraction of the cover, e.g., the friction due to the beaded tape edges 22 of the cover 11 sliding within the "C" channels of the tracks 19 increase and decreases as the cover 11 extends and retracts back and forth across the pool.

From the above analysis, it should be appreciated that the tension load imposed on the system by the pumping motor opposing the driving torque of the driving motor approaches a maximum as the leading edge 15 of the cover 11 reaches the end points of its travel at either end of the pool. And, the resistance torque due to friction is at a maximum when the cover is fully extended.

The conduit dimensions of the respective input/output lines 38 & 40, and the respective flow restrictors 59 in those lines or a combination of both establish the exhaust pressure against which the pumping motor pumps, hence the tension load or resistance imposed on the system by the pumping motor. The adjustable pressure relief valves 56 establishes the pressure of the hydraulic liquid from the pump 47 and, hence, the torque available to the driving motor for rotating either the cover drum 12 or the cable reels 16. By appropriate adjustment of the respective pressure relief valves 56, it is possible to counterbalance the driving torque of the driving motor with the tension load imposed by the pumping motor for slowing and even effectively stopping extension/retraction of the cover 11 as its leading edge 15 approaches its end points of travel.

In practice, however, to assure complete extension and retraction of the cover 11, the differential pressure of the driving and exhaust hydraulic liquids should always be adjusted such that the driving torque winding the cables or cover will just exceed the maximum resistive torque. Stops 63 located at the respective ends of the pool to stop movement of the leading edge 15 are utilized to increase the tension load on the components 52 sufficiently for counter-balancing the torque of the driving motor. Such stops 63 need only be able to mechanically withstand the differential load of the driving motor and the opposing tension load imposed by the pumping motor. (Such stops are inherent in under track pool cover systems comprising the copings at the respective ends of the pool which mechanically stop movement of the rigid leading edge 15).

The differences between operational loads experienced during extension and those experienced during retraction caused by, for example, the increase/decrease of friction as a function of cover extension are compensated through appropriate adjustment of the initial winding/unwinding radii of the cables 21 and cover 11. For example, the operational effect of increasing/decreasing friction during cover extension/retraction can be offset by decreasing the initial winding radius of the cable reels 16. In particular, since both the driving and resistive (pumping) torques of the motor 43 coupled to the cable reels remain essentially constant, the increase in friction load as the cover extends can be offset by increasing the available winding force obtained by the decrease in the cable winding radius. Similarly, the decreasing friction load on cover retraction is offset by an increase in tension load which again is obtained by decreasing the winding radius. And, it should be appreciated that the winding radius of the cover increases as the cover retracts causing the torque resisting windup to increase offsetting the decreasing component of resistance torque due to the decreasing friction of the beaded tape edges 22 sliding in the "C" channels of the tracks 19.

Also, as discussed in Applicant's U.S. Pat. No. 5,067,184 entitled "COVER DRUM HAVING TAPERED ENDS FOR AN AUTOMATIC SWIMMING POOL COVER," the winding/unwinding radius of the cover roll around the cylindrical cover drum 12 can also be manipulated or adjusted as the cover winds and unwinds by thickening sections of the cover with angularly oriented strips of a suitable material such as foam (not shown). The increase in cover thickness due to such strips increases the radius of the cover roll as a function of the position of the leading edge 15 of the cover 12 relative to the cover drum 12. Such increases in the winding/unwinding radius effectively increases the torque resisting windup during retraction as the foam sections wind around the cover drum. And, on cover extension, since the unwinding radius is greater when such foam strips are still wound around the drum 12, less force (tension) is required in the cables and cover to cause the drum 12 and cover roll to unwind, i.e., less force (tension) is required for overcoming the torque resistance of the drum motor 42 acting as a pump. It is preferable to orient such thickening strips angularly with respect to the direction of travel of the cover such that the strips helically wind and unwind from around the drum to mitigate strain caused by differential stretching in the cover fabric in the affected transverse regions of the cover over time.

Figure 5:
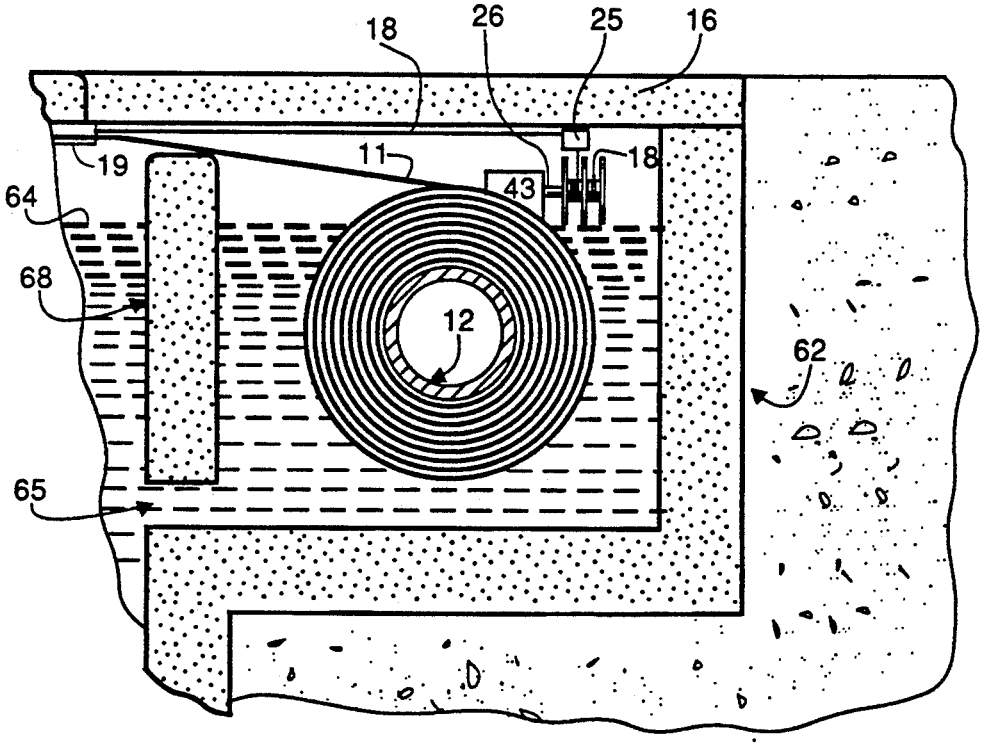
FIG. 5 is a side elevation schematic of the cover drum with the pool cover wound around it disposed in a flooded trench illustrating counterbalancing of the buoyancy forces and the bending moments on the drum.

Referring now to FIG. 5, because of the absence of electrical components in the pool environment, with the described hydraulic drive system, it is possible place the cover drum 12 and associated drive motor 42 in a trench 62 at one end of the swimming pool 68 and allow it to fill with pool water 64, via, for example, a port 65 communicating from the bottom of the cover roll trench 62 into the swimming pool 68. In this situation, the buoyancy of the pool water 64 offsets the effect of gravity providing lateral support to the cover drum 12 as the cover 11 winds around it. In particular, for wide pools, the weight of the pool cover 11 winding around the cover drum 12 can cause the drum 12 to sag or bend in the center creating twisting or torque moments on the respective bearings supporting the drum 12 for rotation. Such twisting or torque moments, being perpendicular to the rotational axis of the cover drum drive train increase bearing friction and wear. Also, excessive sag of the cover drum 12 inherently increases torque resisting windup, in that the effective windup radius of the cover around the drum increases with increasing sag. Finally, utilizing the buoyancy afforded by the pool water to provide lateral support to the cover drum and cover winding around drum lessens mechanical rigidity and strength requirements for the components of the cover drum drive train with a resultant savings in materials costs and mass.

Looking at FIG. 5, it should be noted that the reversible hydraulic motor 43, the axle 26 and associated cable reels 16 are oriented and rotate about an axis perpendicular to that of the cover drum 12 and its associated motor 42. The respective motor 42 & 43 are mounted in a common frame structure (not shown). To assure ease of access and to mitigate adverse corrosion problems, the steel cables and cable reels should be mounted in that frame structure above the cover drum motor 42 such that the cables 18, associated return pulleys 25 and reels 16 are all above the water surface in the trench 62. (FIG. 5)

Figure 3A:
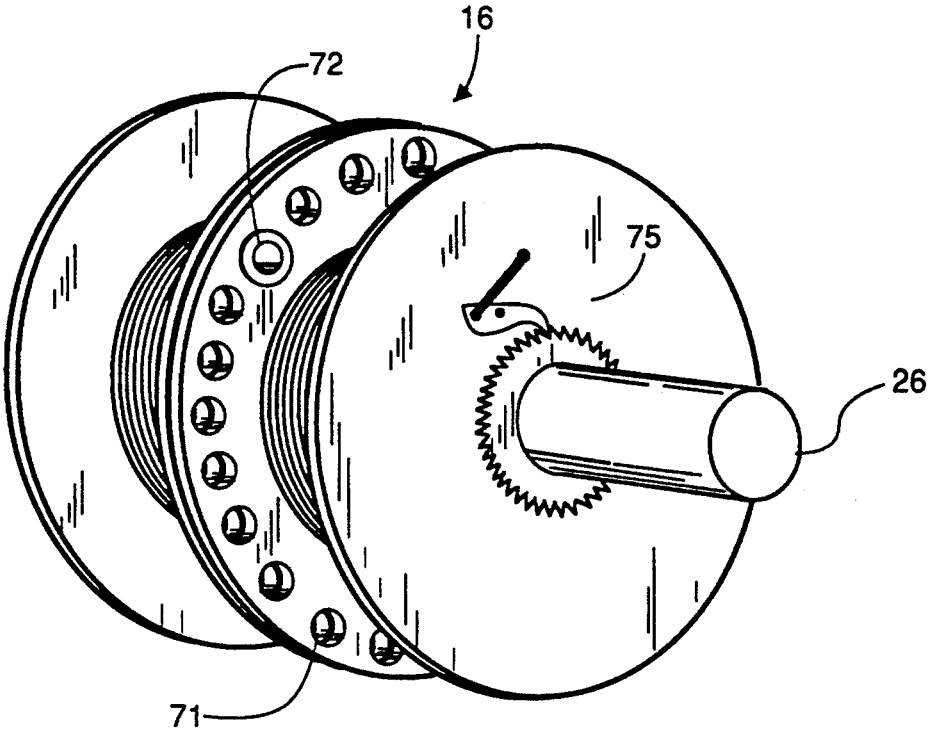
FIGS. 3*a* and 3*b* illustrate an exemplary coupling of the respective cable reels rotated by a hydraulic motor drive.
Figure 3B:
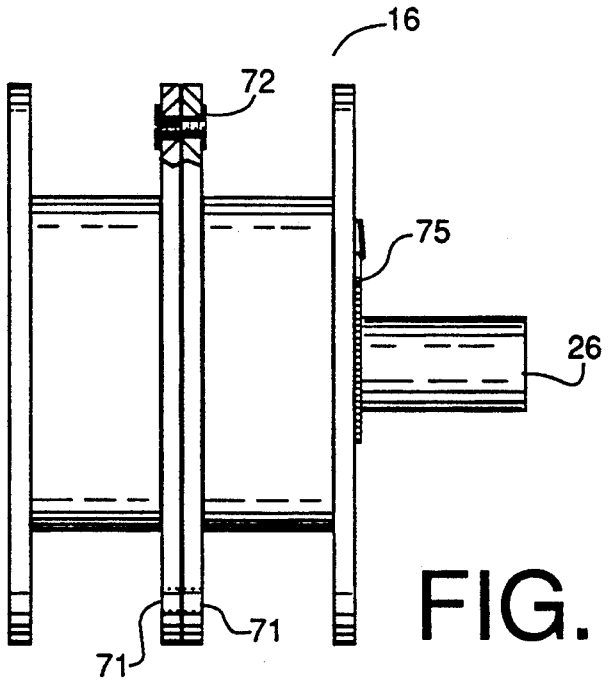

With reference to FIGS. 1, 3*a* & 3*b* with the invented drive system, steps must be taken to prevent canting of the rigid leading edge 15 supporting and drawing out the front edge 14 of the cover 11 as it moves back and forth across the pool [See Applicant's U.S. Pat. No. 4,939,798, entitled "LEADING EDGE AND TRACK SLIDER SYSTEM FOR AN AUTOMATIC SWIMMING POOL COVER" and U.S. Pat. No. 5,067,184 entitled, "A COVER DRUM HAVING TAPERED ENDS FOR AN AUTOMATIC SWIMMING POOL COVER."] In particular, it is not absolutely necessary to provide a floating pulley system for equalizing tension in the respective cable lines. In fact, in circumstances, as here, where small diameter steel cable cables 18 are utilized, multiple changes in direction about small pulley radii required in such floating pulley cable return system are detrimental.

To solve the problem, it should be appreciated that the winding and unwinding radii of the respective cable reels 16 must remain essentially equal as the cover extends and retracts back and forth across the pool to assure that the respective lengths of steel cable winding and unwinding from around the respective cable reels 16 per rotation remain essentially equal. With reference to FIG. 3, if the winding/unwinding radius of one the cable reels 16 becomes greater than that of the other, and/or if one of the steel cables shortens in length because of independent adjustments to other components of the system, it is necessary equalize the winding/unwinding radii of the reels 16 and the lengths of the respective cables 18 by turning reels with respect to each other on the reel axle 26. Once the adjustment equalizing the winding/unwinding radii of the reels 16 and cable lengths is accomplished, the cable reels must co-rotate.

As shown in FIGS. 3*a* & 3*b*, to assure such co-rotation, the adjacent reels 16 each have a circumferential row of holes 71 at the same radius which move into registry as the respective reels rotate around the axle 26 relative to each other. At the point where the winding-/unwinding radii of the reels 16 and the cable lengths are equalized one or more bolts 72 are inserted through registering holes 71 of the respective reels 16 to prevent the reels from rotating relative to each other. This same adjustment can be accomplished by utilizing separate ratcheting mechanisms for coupling rotation of the respective reels to the axle 26. However, in such instance, each time tension on the cables 18 is released to allow lateral adjustment of the cover drum position between the tracks 19, the winding/unwinding radii of the reels 16 and cable lengths must be re-equalized.

Further, the steel cable type for the small diameter cables 18 coupling between the sliders 20 and cable reels 16 should be selected to have minimal stretch, i.e. to have a maximum Young's Modulas of Elasticity, to assure that the lengths of the respective cables between the return pulleys 25 and the sliders 20 remain equal.

If the above conditions are maintained, the inherent elasticity of the cover 11 and particularly its beaded side edges 22 will effectively, but not optimally assure, that the cover 11 will wind and unwind squarely from around the cover drum 12 after proper adjustment. [See Applicant's U.S. Pat. No. 5,067,184].

To explain, as the cover begins a cant, there will be an incremental increase in distance between one of the sliders 20 and the tangential point where the beaded tape edge 22 on the same side of the cover 11 begins to wind/unwind from around the cover drum hub 13 relative to that distance between the slider and cover drum hub 13 on the other side. For sake of convention, the side of the cover 11 with greater distance between the slider 20 and the cover drum hub 13 is referred to as the long side while the other side is referred to as the short side.

Because of their relative inelasticity, the respective steel cables 18 on both the long and short sides of the cover when measured between to the return pulleys 25 and the respective sliders 20 will have essentially the same or equal lengths. Accordingly, when the cover is extending, i.e., when it is being pulled across the pool by winding the cables 18 around the cable reels 16, and a cant initiates because of a wrinkle, or towel left on the cover surface, the tension on the short side of the cover increases incrementally while tension on the long side does not. The greater tension on the short side has the effect of stretching the cover and beaded tape on that side more than on the long side, and of tightening of the cover roll around that side of the cover drum causing the short side of the cover to lengthen. These tension effects combine to compensate for such incremental cant.

Similarly, when the cover 11 is retracting, i.e. when it is being pulled across the pool by winding of the cover 11 around the cover drum 12, and a cant initiates because of a wrinkle, or towel left on the cover surface, the tension on the short side of the cover increases incrementally while tension on the long side decreases. The greater tension on the short side has the effect of stretching the cover and beaded tape on that side more than on the long side, and of tightening of the cover roll around that side of the cover drum causing the short side of the cover to lengthen. The lessening of tension on the long side allows the cover and associated beaded tape edge to contract and the winding cover roll on that side to loosen and increase in radius. Again these tension effects combine to compensate for an incremental cant as it initiates.

If the cant initiates because of an impediment to sliding of one of the sliders 20 or a beaded tape edge within a 'C'-Channel of one of the tracks 19, when the cover is extending, tension load in the steel cable on the short side of the cover will sharply increase to a point where the either resistance of the impediment or the torque of the driving motor 43 rotating the cover reels 16 is overcome. In this situation, tension load on the steel cable 18 on the long side of the cover simultaneously decreases allowing the cover and associated beaded edge to contract and the cover roll to loosen shortening that side of the cover. Accordingly, the tension effects in this situation tend to inherently off set or correct for a cant.

However, when the cover is retracting, an impediment to the sliding of the slider 20 or beaded tape edge in the 'C'-channel of a track will sharply reduce the tension in the steel cable 18 and sharply increase the tension in the beaded tape on the long side of the cover until the either resistance of the impediment or the torque of the driving motor 42 rotating the cover drum 12 is overcome. The tension load on the steel cable 18 and beaded tape on the short side of the cover does not change significantly. In this case, the degree of inherent compensation due to changing tension loads is not as dramatic and the the adjustable pressure relief valve 56 establishing maximum torque of the motor 42 for rotating the cover drum should be set accordingly.

The invented dual hydraulic motor system for automatic swimming pool covers has been described in context of both representative and preferred embodiments. There are many modifications and variations can be made to the invented drive system which, while not exactly described herein, fall within the spirit and the scope of invention as described and set forth in the appended claims.

I claim:

1. A hydraulic drive system for extending and retracting swimming pool covers comprising, in combination, a first reversible hydraulic motor having a drive mechanically coupled for rotating at least one cable reel around which a pair of cables, each coupled to a front side edge of a pool cover, wind and unwind, a second reversible hydraulic motor having a drive mechanically coupled for rotating a cover drum around which the pool cover winds and unwinds, a hydraulic liquid, a means for pressurizing and circulating the hydraulic liquid through hydraulically coupled elements of the drive system, and means hydraulically coupling the respective motors and the means for pressurizing and circulating the hydraulic liquid for:

(i) providing a driving torque, via the first motor, for rotating the cable reel to wind the cables around the reel while simultaneously providing a resistive torque, via the second motor, for resisting unwinding rotation of the cover drum as the cover unwinds and is drawn across covering the pool; and (ii) providing a driving torque, via the second motor for rotating the cover drum to wind the cover around the cover drum, while simultaneously providing a resistive torque, via the first motor, for resisting unwinding rotation of the cable reels to tension the cables and cover as the cover retracts uncovering the pool.

2. The hydraulic drive system for extending and retracting swimming pool covers of claim 1 wherein the first and second reversible hydraulic motors are each driven as a pump to provide the respective resistive torques to the unwinding rotation of the cable reel and cover drum respectively, and wherein the particular motor providing the driving torque, the driving motor, supplys hydraulic liquid to the hydraulic motor driven as a pump, the pumping motor.

3. The hydraulic drive system for extending and retracting swimming pool covers of claim 2 wherein the cable reel, cables, pool cover and cover drum provide a direct mechanical coupling between the respective drives of the of the first and second motors, whereby, torque provided by the driving motor is translated by such compnents of the pool cover mechanically coupling the respective drives into a torque for rotating the pumping motor.

4. The hydraulic drive system for extending and retracting swimming pool covers of claim 3 wherein the means for pressurizing and circulating the hydraulic liquid further includes means for reversibly circulating the hydraulic liquid through the hydraulically coupled elements of the drive system.

5. The hydraulic drive system for extending and retracting swimming pool covers of claim 4 wherein the means hydraulically coupling the respective motors to the means for circulating the hydraulic liquid under pressure through the hydraulically coupled elements of the drive system includes:

a) a common line hydraulically coupling the respective reversible hydraulic motors such that output liquid from the motor providing driving torque is available as input liquid to the motor functioning as the pump providing the resisting torque;

b) a first input/output line hydraulically coupling the first reversible hydraulic motor to the means for circulating the hydraulic liquid;

d) a second input/output line hydraulically coupling the second reversible hydraulic motor to the means for circulating the hydraulic liquid;

g) a first check valve means hydraulically coupling the common line to the first input/output line for permitting liquid flow from the common line to the first input/output line responsive an excess of hydraulic liquid in the common line supplied by the second reversible motor functioning as the driving motor and for preventing liquid flow from the first input/output line to the common accumulator line;

h) a second check valve means hydraulically coupling the common line to the second input/output line for permitting liquid flow from the common line to the second input/output line responsive an excess of hydraulic liquid in the common line supplied by the first reversible motor functioning as the driving motor and for preventing liquid flow from the second input/output line to the common accumulator line.

6. The hydraulic drive system for extending and retracting swimming pool covers of claim 5 wherein the first check valve means also includes means for hydraulically coupling the first input/output line to the common accumulator line to permit liquid flow from the first input/output line to the common line responsive to a high pressure in the second input/output line and for preventing liquid; flow from the first input/output line to the common line responsive to a low pressure in the second input/output line, and wherein the second check valve means also includes means for hydraulically coupling the second input/output line to the common accumulator line to permit liquid flow from the second input/output line to the common accumulator line responsive to a high pressure in the first input/output line and preventing liquid flow from the second input/output line to the common accumulator line responsive to a low pressure in the first input/output line.

7. The hydraulic drive system for extending and retracting swimming pool covers of claim 6 wherein the first check valve means is a pilot pressure locking valve which receives a pilot pressure from the second input/output line for opening a normally closed check valve which prevents liquid flow from the first input/output line to the common; and wherein the second check valve means is a pilot pressure locking valve which receives a pilot pressure from the first input/output line for openning a normally closed check valve which prevents liquid flow from the second input/output line to the common line.

8. The hydraulic drive system for extending and retracting swimming pool covers of claim 7 wherein the means for reversibly circulating the hydraulic liquid through the hydraulically coupled elements of the drive system comprises, in combination, a three way valve means for directing circulation of hydraulic liquid from the means pressurizing and circulating the hydraulic liquid to three different hydraulic liquid circulation loops consisting of an extension circulation loop for extending the cover across the pool, a retraction circulation loop for retracting the cover from across the pool and a neutral circulation loop, where:

(i) in the extension circulation loop, hydraulic liquid circulates from the means pressurizing and circulating the hydraulic liquid through the three way valve means to the first input/output line, then to the first reversible hydraulic motor, then to the common accumulator line, then to the second reversible hydraulic motor, out the second input/output line to the liquid reservoir tank, and back to the means pressurizing and circulating the hydraulic liquid;

(ii) in the retraction loop, hydraulic liquid circulates from the means pressurizing and circulating the hydraulic liquid through the three way valve means to the second input/output line, then to the second reversible hydraulic motor, then to the common accumulator line, then to the first reversible hydraulic motor, out the first input/output line to the hydraulic liquid reservoir tank, and back to the means pressurizing and circulating the hydraulic liquid; and (iii) in the neutral loop, hydraulic liquid circulates from the means pressurizing and circulating the hydraulic liquidthrough the three way valve means to the hydraulic liquid reservoir tank, and back to the means pressurizing and circulating the hydraulic liquid; and an adjustable pressure relief valve means hydraulically coupling the means pressurizing and circulating the hydraulic liquid to the hydraulic liquid reservoir tank for establishing an upper limit on liquid pressure supplied from the the means pressurizing and circulating the hydraulic liquid.

9. The hydraulic drive system for extending and retracting swimming pool covers of claim 7 wherein the means for pressurizing and circulating the hydraulic liquid and means for reversibly circulating the hydraulic liquid through the hydraulically coupled elements of the drive system comprise, in combination, a reversible hydraulic pump connected for circulating the hydraulic liquid in a hydraulic loop which includes, in a forward direction for extending the cover across the pool, the first input/output line, the first reversible hydraulic motor, the common accumulator line, the second reversible hydraulic motor, the second input/output line and the reversible pump, and which includes, in a reverse direction for retracting the pool cover from across the pool, the second input/output line, the second reversible hydraulic motor, the common accumulator line, the first reversible hydraulic motor, the first input/output line and the reversible pump, a first check valve means hydraulically coupling the first input/output line to a hydraulic liquid reservoir for preventing liquid flow from the reversible pump to the reservoir when the reversible pump is circulating hydraulic liquid in the loop in the forward direction and for permitting liquid flow from the reservoir through the reversible pump when the reversible pump is circulating hydraulic liquid in the loop in the reverse direction, a second check valve means hydraulically coupling the second input/output line to the hydraulic liquid reservoir for preventing liquid flow from the reversible pump to the reservoir when the reversible pump is circulating hydraulic liquid in the loop in the reverse direction and for permitting liquid flow from the reservoir through the reversible pump when the reversible pump is circulating hydraulic liquid in the loop in the forward direction, an electrically energized motor means for rotatably driving the reversible pump in opposite directions for circulating the hydraulic liquid in the forward and reverse directions and manual control means for selecting the direction the electrically energized motor means rotatably drives the reversible pump.

10. The hydraulic drive system for extending and retracting swimming pool covers of claim 9 and further including:

i) a first adjustable pressure relief valve means hydraulically coupling the first input/output line to the hydraulic liquid reservoir tank for establishing an upper limit on liquid pressure supplied from the reversible hydraulic pump available for generating driving torque at the drive of the first hydraulic motor; and j) a second adjustable pressure relief valve means hydraulically coupling the second input/output line to the hydraulic liquid reservoir tank for establishing an upper limit on liquid pressure supplied from the reversible hydraulic pump available for generating driving torque at the drive of the second hydraulic motor.

11. The hydraulic drive system for extending and retracting swimming pool covers of claim 10 or 8 and further including:

k) a first flow restrictor means incorporated into the first input/output line hydraulically between the first pilot pressure locking valve means and the first reversible motor for restricting flow from the first reversible motor when it functions as a pump establishing a resistance torque to unwinding rotation of the cable reel as the cover retracts from across the pool;

l) a first bypass check valve means for hydraulically bypassing the first flow restrictor and for hydraulically coupling the means reversibly circulating the hydraulic liquid through the hydraulically coupled elements to the first reversible motor for providing torque for rotating the cable reel winding up the cables extending the cover across the pool;

m) a second flow restrictor means incorporated into the second input/output line hydraulically between the second pilot pressure locking valve means and the second reversible motor for restricting flow from the second reversible motor when it driven as a pump and establishing a resistance torque to unwinding rotation of the cover drum as the cover extends across the pool;

l) a second bypass check valve means for hydraulically bypassing the second flow restrictor and for hydraulically coupling the means reversibly circulating the hydraulic liquid through the hydraulically coupled elements to the second reversible motor for providing torque for rotating the cover drum for winding up the pool cover retracting the cover from across the pool.

12. The hydraulic drive system for extending and retracting swimming pool covers of claim 10 wherein the means pressurizing and circulating the hydraulic liquid comprises an electrically energized motor rotably driving a hydraulic liquid pumping means for pumping the liquid from the reservoir tank through the respective hydraulic liquid circulation loops.

13. The hydraulic drive system for extending and retracting swimming pool covers of claim 1 wherein the cover drum is immersed in pool water at one end of a pool for providing lateral buoyant support to the cover drum and cover winding and unwinding from around the cover drum.

14. The hydraulic drive system for extending and retracting swimming pool covers of claim 13 wherein the cover drum and second reversible hydraulic motor coupled for rotating the drum are located within a trench at one end of the swimming pool and wherein at least one port communicates between the trench and the swimming pool for allowing pool water to circulate into and flood the trench.

15. The hydraulic drive system for extending and retracting swimming pool covers of claim 1 and further including:

a pair of sliders each including a main body, a necked section and a cylindrical sliding edge with a first and a second receptacle, each receptacle extending into an end of the cylindrical sliding edge aligned with the longitudinal axis of the sliding edge, the first receptacle being adapted to and receiving an end of a line extending from a front side edge of the pool cover, the second receptacle being adapted to and receiving a small diameter inelastic cable extending between the slider and the take-up reel, the cylindrical sliding edge of each slider and associated side edges of the pool cover being captured by and sliding within a 'C'-channels of swimming pool cover track secured along one side of a swimming pool;

at least one smooth shank anchoring screw piercing diametrically through the cylindrical sliding edge, through the line received in the first receptacle, and through the adjoining necked section to anchor in the main body of each slider, a cable anchoring passageway communicating through the main body of each slider, and through the necked section to perpendicularly intersect with the second receptacle, an end of one of the small diameter inelastic cables extending into the second receptacle, then at a right angle through and out the anchoring passageway, and stop means secured to the end of each small diameter inelastic cable extending out the anchoring passageway for preventing that end of the small diameter inelastic cable from slipping through the anchoring passageway.

* * * * *